United States Patent [19]

Simmons

[11] Patent Number: 4,750,887

[45] Date of Patent: Jun. 14, 1988

[54] ANCHOR BOLT ASSEMBLY

[76] Inventor: Walter J. Simmons, Rte. 2, Box 234, Martinsburg, W. Va. 25411

[21] Appl. No.: 948,132

[22] Filed: Dec. 31, 1986

Related U.S. Application Data

[63] Continuation of Ser. No. 895,672, Aug. 11, 1986, abandoned.

[51] Int. Cl.[4] ..... E21D 20/02

[52] U.S. Cl. ..... 405/260; 405/261

[58] Field of Search ..... 405/259, 260, 261, 262; 411/39–43, 69, 82, 258, 383, 385

[56] References Cited

U.S. PATENT DOCUMENTS

| | | | |
|---|---|---|---|
| 3,379,019 | 4/1968 | Williams | 405/260 |
| 3,815,368 | 6/1974 | Turzillo | 405/260 |
| 4,129,007 | 12/1978 | Rausch | 405/261 |
| 4,325,657 | 4/1982 | Elders | 405/259 |
| 4,393,638 | 6/1983 | Sell et al. | 405/261 X |
| 4,419,805 | 12/1983 | Calandra | 29/458 |
| 4,440,526 | 4/1984 | Koppers et al. | 405/260 |
| 4,511,289 | 4/1985 | Herron | 405/259 |
| 4,514,111 | 4/1985 | Issakainen | 405/260 |
| 4,564,315 | 1/1986 | Rozanc | 405/260 X |
| 4,655,645 | 4/1987 | Hipkins et al. | 405/261 |
| 4,704,053 | 11/1987 | Hipkins et al. | 405/261 |

FOREIGN PATENT DOCUMENTS

| | | | |
|---|---|---|---|
| 2412667 | 10/1974 | Fed. Rep. of Germany | 405/260 |

OTHER PUBLICATIONS

Brochure, "Spiral Bolt," F. M. Locotos Co., Inc., two pages, undated.

*Primary Examiner*—Dennis L. Taylor
*Attorney, Agent, or Firm*—James T. Corle

[57] ABSTRACT

An anchor bolt assembly for securing a bolt in a bore hole having a settable bonding material therein utilizes a standard smooth bolt or a rebar which has a head on one end and which is threaded to receive a nut on the other end. Improved mixing of the bonding material and improved tensioning of the bolt is achieved by attaching a rod or wire to the nut or head and to a second point of attachment along the bolt.

11 Claims, 2 Drawing Sheets

ANCHOR BOLT ASSEMBLY

This is a continuation of application Ser. No. 895,672, filed Aug. 11, 1986, now abandoned.

BACKGROUND OF THE INVENTION

1. Field of the Invention

This invention relates to an anchor bolt assembly. More particularly, the invention relates to an anchor bolt assembly useful in bore holes containing a settable bonding material. Such assemblies are useful in anchoring heavy machinery, in construction applications, and mine roof supports.

2. Description of Related Art

It is well known in the art of mine roof support and related anchoring systems to tension bolts by the use of the mechanical expansion system in combination with a settable bonding material. The popular bonding materials are provided in compartmented packages in which a resin and a catalyst for the resin are separated. Such a system is disclosed in U.S. Pat. No. 4,280,943. Proper mixing of the catalyst and resin as well as final tensioning of the anchor bolts have been problems. Mixing must take place within seconds and final tensioning within a very few minutes.

Anchor bolts having various profiled configurations have been used to promote mixing. Illustrative of this type of anchoring device is that shown in U.S. Pat. No. 4,393,638. A tapered bolt having grooves and ridges having a spiral configuration is said to promote mixing of the resin and force it into the inner end of the bore. A bolt having a helical channel adjacent the end is shown in U.S. Pat. No. 4,564,315. Such devices require machining or forming and are somewhat costly to manufacture.

Tensioning of the bolts has been achieved using various bolt and expansion shell configurations. Bolt and shell combinations of the type shown in U.S. Pat. No. 4,413,930, depend on tensioning by advancing a camming plug which is threaded onto the bolt through an anchoring shell. Expanding fingers on the shell grip the bore wall holding it in place while it is placed under tension. Such mechanical devices, although effective in tensioning the bolt, create highly concentrated loading on the walls of the bore hole which can crack the walls.

SUMMARY OF THE INVENTION

This invention relates to an anchor bolt assembly of simplified construction which provides a combination of excellent resin mixing and tensioning characteristics without the need for a camming plug or expanding fingers. To promote mixing, a rod or wire is attached to a bolt having a head on one end and a threaded portion which is adapted to receive a nut on the other end. The points of attachment which are spaced apart may be weldments of different strengths. Preferably the rod or wire is attached to the nut and the bolt. The points of attachment may be selected so that the rod is straight or spiraled along the length of the bolt. When the anchor bolt assembly is forced into a bore hole containing a compartmented package of settable bonding material and the bolt is rotated, the rod assumes a spiraled configuration mixing the resin and catalyst and forcing the mixture toward the top of the bore hole. As the resin cures, drag on the rod increases, and eventually the rod detaches at the point of the weakest weld. After the rod breaks free, the nut is free to rotate relative to the bolt.

When the partially cured resin becomes strong enough to prevent the nut from turning, the bolt threads itself onto the nut. The nut is pulled down into the partially cured resin, putting it in compression and forcing the resin to expand. As the nut is moving downward, the resin reaches a cure strength sufficient to stop its movement. This stalls the bolt rotation. Installation is complete and the bolt is in tension.

In an alternative embodiment, the assembly is inserted into the bore hole head first. The head is shaped to permit passage of resin and catalyst as the assembly is positioned in the bore hole. Preferably one end of the rod is attached to the head of the bolt, and the other end is attached to a nut which will be threaded onto the portion of the bolt which will protrude from the bore hole. A roof plate or washer is placed on the protruding portion of the bolt between the surface of the bore hole and the nut. The nut is prevented from rotating during the mixing cycle until curing of the resin advances to a level at which the rod breaks free at its weakest point of attachment. As the nut is threaded onto the bolt, the head is pulled down into the partially cured resin forcing the resin to expand and putting it in compression. When the resin reaches sufficient cure strength, movement of the bolt is stalled, and the bolt is placed in tension.

DETAILED DESCRIPTION

Figure 1:
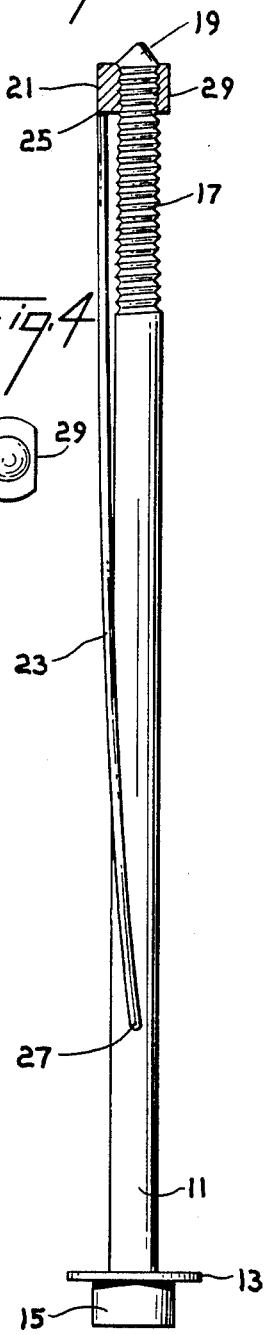
FIG. 1 is a side elevation view partially in section of the anchor bolt assembly illustrating a nut positioned on the threaded end of an elongated bolt with an elongated rod being attached to the nut and to the bolt.

The anchor bolt assembly of the present invention includes an elongated bolt 11 having a flange 13 and head 15 on one end. The opposite end of bolt 11 has a threaded portion 17 and a tapered end 19. The threaded portion 17 is adapted to receive nut 21. As shown in FIG. 1, an elongated rod 23 is attached to nut 21 at point 25 and is loosely spiraled to a point of attachment 27 on bolt 11. In the preferred embodiment of this invention as shown in FIG. 1, the elongated rod 23 extends along bolt 11 to a point of attachment 27. The length of rod 23 can be longer or shorter as desired. In addition to point of attachment 27, rod 23 may be attached at additional points if desired.

Figure 4:
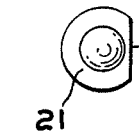
FIG. 4 is a top plan view of the nut for the bolt showing a cutaway portion of the shoulder of the nut.

As shown in FIG. 4, nut 21 has a cutaway shoulder 29. The shape and diameter of nut 21 is selected to permit entry of the nut into the bore hole and passage of the settable bonding material between the nut and the walls of the bore hole.

Figure 2:
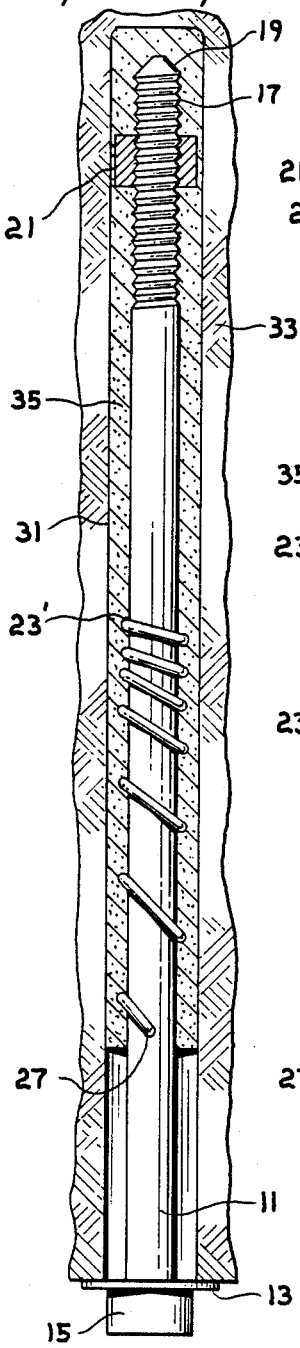
FIG. 2 is a view similar to FIG. 1 illustrating the assembly positioned in rock strata with the threaded end of the bolt advanced into the nut and the rod detached from the nut and coiled about the bolt so that the flange on the bolt is urged into abutting relationship with the rock strata to apply tension on the bolt after the resin in the bore hole has cured to secure the rod therein.

FIG. 2 illustrates the anchor bolt assembly positioned within bore hole 31 in rock strata 33. The assembly has been inserted with the tapered end portion 19 first entering the bore hole and piercing a frangeable package containing a settable bonding material such as that disclosed in U.S. Pat. No. 4,280,943. When fully inserted, the assembly is rotated rapidly for about 15 seconds. The rotation of bolt 11 and the drag of the curing resin causes rod 23 to coil around bolt 11. Resin 35 begins to cure, and as the drag on rod 23 increases, it breaks away from point of attachment 25. Continued rotation of bolt 11, causes the bolt to be threaded through nut 21 which is partially frozen in the curing resin. Threaded portion 17 of bolt 11 is preferably coated with a release agent which prevents the curing resin from bonding nut 21 to the threads. Nut 21 is pulled down into the partially cured resin, putting the resin into compression and forcing it to expand.

Figure 3:
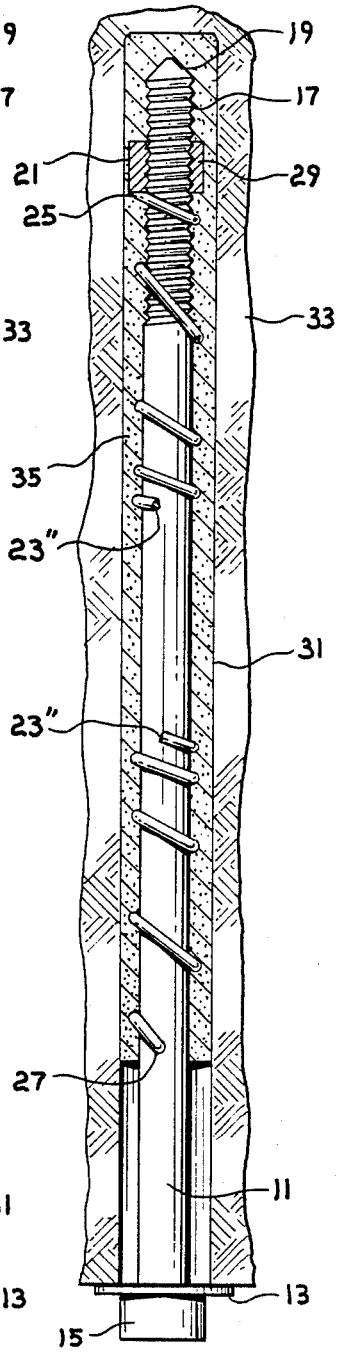
FIG. 3 is a view similar to FIG. 2 illustrating the bolt in tension with the rod having broken at a location intermediate the points of attachment and being coiled about the bolt in two sections of the bore hole.

Another embodiment of the anchor bolt assembly installed in rock strata 33 is shown in FIG. 3. In FIG. 3, rod 23 has been intentionally weakened at a point intermediate points of attachment 25 and 27. As resin 35 starts to cure, rod 23 breaks, leaving end points 23" spaced apart as the two sections of rod 23 coil about bolt 11. In still another embodiment, not shown, rod 23 breaks away from point of attachment 27 and coils upwardly toward nut 21.

Figure 5:
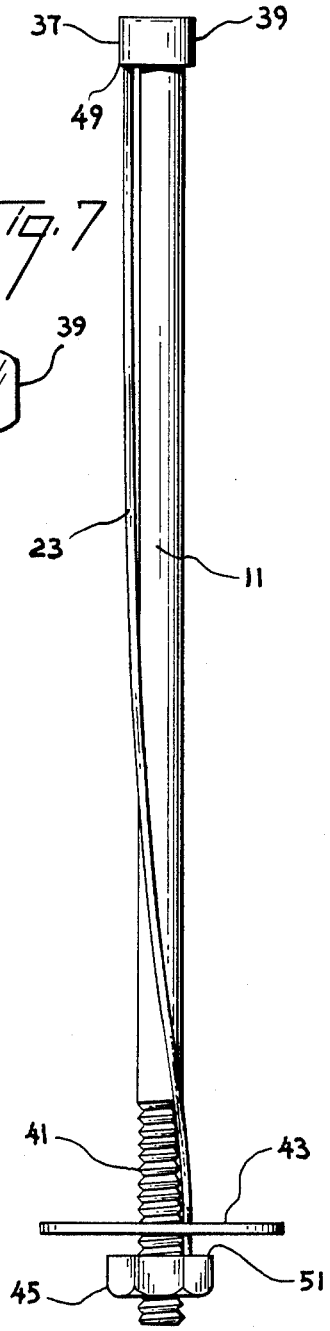
FIG. 5 is a side elevation view partially in section of another embodiment of the anchor bolt assembly in which the elongated rod is attached to the head of the bolt and nut which is threaded onto the portion of the bolt at its opposite end.
Figure 6:
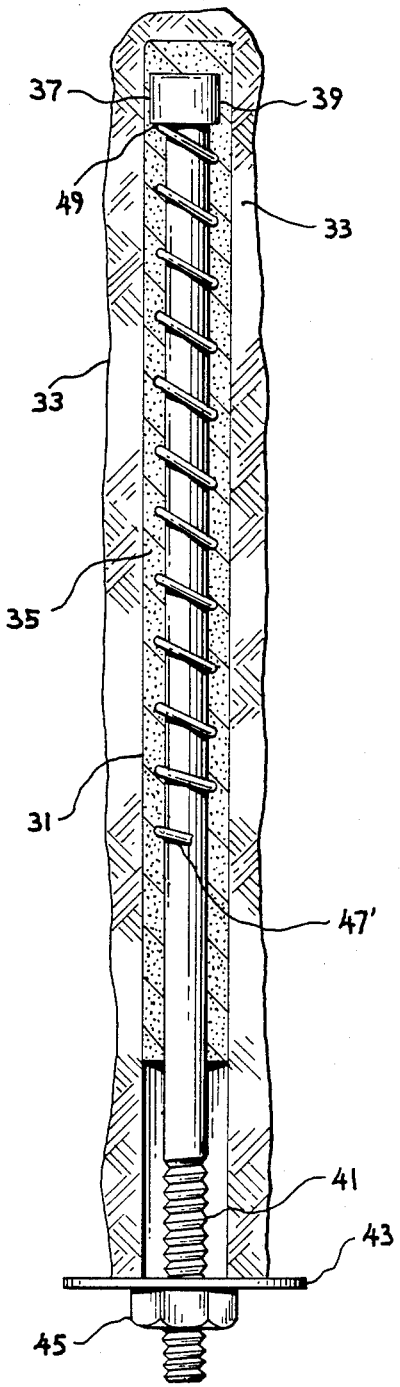
FIG. 6 is a view similar to FIG. 5 illustrating the assembly positioned in rock strata with the rod detached from the threaded end of the bolt and coiled about the bolt with the nut urged against a roof plate to apply tension on the bolt.
Figure 7:
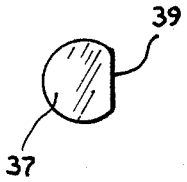
FIG. 7 is a top plan view of the bolt head showing a cutaway portion of the shoulder of the head.

FIGS. 5 and 6 illustrate another embodiment of the invention. In this embodiment, bolt 11 is adapted to be inserted in bore hole 31 in rock strata 33 with the head 37 entering the bore hole first. Head 37 is configured with a shoulder 39 similar to nut 21 as illustrated in FIG. 7 Various configurations can, of course, be used. Rod 23 is attached at point 49 on head 37 and at point 51 on nut 45. The weldments at points 49 and 51 are of different strengths so that rod 23 selectively detaches at point 51 during the rotation and tensioning of the assembly. Rotation of bolt 11 and the drag of the curing resin causes rod 23 to detach from point 51 and coil about bolt 11. The detached end of rod 23 moves upward to point 47'. In this embodiment, a roof plate or washer 43 is positioned over the threaded portion 41 of bolt 11 and rod 23. Nut 45 when tightened places bolt 23 in tension.

Various materials of construction may be used in the manufacture of the anchor bolt assembly. Where high strength applications such as in mine roofs are involved, steel would be a preferred material. In anchoring machinery and other applications which do not require such high strength, various plastic materials are available. Settable bonding materials include polyesters, epoxys, other known synthetic resins and inorganic grouts which are commercially available. A particularly desireable material is sold under the trademark Fasloc by E. I. du Pont de Nemours and Company.

I claim:

1. In an anchor bolt assembly for securing a bolt in a bore hole having a settable bonding material therein comprising an elongated bolt having a head on one end and a threaded portion for receiving a nut at the other end, the improvement comprising in combination, (a) an essentially straight elongated rod for mixing said settable bonding material in a bore hole and (b) a bolt, the ends of said rod being attached to said bolt, (c) said rod being selectively releasable from attachment at one end when said bolt is rotated in a bore hole and subjected to increasing drag of said settable bonding material as said bonding material cures in said hole.

2. An anchor bolt assembly for securing a bolt in a bore hole having a settable bonding material therein comprising (a) an elongated bolt having a head on one end and a threaded portion at the other end, (b) a nut positioned on the threaded portion of said bolt shaped to permit entry into said bore hole and to permit passage of settable bonding material between said nut and the walls of said bore hole, and (c) a rod for mixing said settable bonding material in said bore hole having one end attached to said nut and at least one other point of attachment to said bolt at a location remote from said nut, said rod being selectively releasable from attachment at at least one point of attachment when subjected to increasing drag of the settable bonding material as said bolt is rotated in said bore hole and said bonding material cures in said hole.

3. The anchor bolt assembly of claim 2 wherein the ends of said rod are attached to the nut and the bolt by weldments.

4. The anchor bolt assembly of claim 3 wherein said rod is loosely spiraled around said bolt in a direction to force said bonding material toward said nut as the assembly is rotated.

5. The anchor bolt assembly of claim 4 wherein said rod selectively releases from its point of attachment to the nut thereby providing a loose end that is free to coil around said bolt as the bolt is rotated.

6. The anchor bolt assembly of claim 4 wherein said rod selectively released from its point of attachment to said bolt.

7. An anchor bolt assembly for securing a bolt in a bore hole having a settable bonding material therein comprising (a) an elongated bolt having a head shaped to permit entry into said bore hole and to permit passage of settable bonding material between it and the walls thereof on one end, and a threaded portion at the other end, (b) a nut positioned on the threaded portion of said bolt, and (c) a rod for mixing said settable bonding material in said bore hole having one end attached at or near the head of said bolt and at least one other point of attachment at a location remote from said head, said rod being selectively releasable from attachment at at least one point of attachment when subjected to increasing drag of the settable bonding material as said bolt is rotated and said bonding material cures in said bore hole.

8. The anchor bolt assembly of claim 7 wherein the ends of said rod are attached by weldments.

9. The anchor bolt assembly of claim 8 wherein said rod is loosely spiraled about said bolt in a direction to force said bonding material towards the head of said bolt as the assembly is rotated.

10. The anchor bolt assembly of claim 9 wherein one end of said rod is attached to the nut and said rod is selectively released from its point of attachment to the nut thereby providing a loose end that is free to coil around said bolt as the bolt is rotated.

11. The anchor bolt assembly of claim 9 wherein said rod is selectively released from its point of attachment remote from the head of the bolt.

* * * * *

UNITED STATES PATENT OFFICE

CERTIFICATE OF CORRECTION

PATENT NO. : 4,750,887

DATED : June 14, 1988

INVENTOR(S) : Walter J. Simmons

It is certified that error appears in the above-identified patent and that said Letters Patent are hereby corrected as shown below:

Column 4, line 42, the word "released" should read --releases--.

Signed and Sealed this

Eighth Day of November, 1988

*Attest:*

DONALD J. QUIGG

*Attesting Officer*

*Commissioner of Patents and Trademarks*